United States Patent [19]

Bastenhof

[11] Patent Number: 4,522,535

[45] Date of Patent: Jun. 11, 1985

[54] SURF WAVE GENERATOR

[75] Inventor: Dirk Bastenhof, Langerak, Netherlands

[73] Assignee: Ecopool Design Limited, Channel Islands

[21] Appl. No.: 521,113

[22] Filed: Aug. 8, 1983

[51] Int. Cl.[3] ..... F04D 35/00

[52] U.S. Cl. ..... 405/79; 4/491

[58] Field of Search ..... 405/79, 52; 4/491, 492

[56] References Cited

U.S. PATENT DOCUMENTS

| | | | |
|---|---|---|---|
| 2,056,855 | 10/1936 | Herz | 4/491 |
| 3,473,334 | 10/1969 | Dexter | 405/79 |
| 3,629,877 | 12/1971 | Schuster | 4/491 |
| 4,276,664 | 7/1981 | Baker | 405/79 X |

FOREIGN PATENT DOCUMENTS

| | | | |
|---|---|---|---|
| 161548 | 9/1979 | Netherlands | 405/79 |

OTHER PUBLICATIONS

Engineers Make Waves for Land-Locked Surfers, (no citation of date or source).

*Primary Examiner*—Dennis L. Taylor

*Attorney, Agent, or Firm*—Weingarten, Shurgin, Gagnebin & Hayes

[57] ABSTRACT

A surf wave generator which can repeatedly produce and launch singular waves across the surface of a swimming pool. The waves are produced in the swimming pool by an adjacent water-filled caisson which is coupled into the swimming pool at the base of the pool and caisson. Except for the opening into the pool, the caisson is sealed, and a charge of high-pressure air is vented into the upper portion, forcing the water from the chamber into the swimming pool in a single forceful motion. Through the use of a baffle, the expelled water is directed within the swimming pool to produce a surf wave propagating across the surface of the swimming pool away from the wave-generating caisson. The surf wave may be repeatably generated without synchronization to the previously generated waves. The surf wave generator can also be used in combination with other wave-generating systems to produce a complete repertoire of wave motions.

10 Claims, 3 Drawing Figures

SURF WAVE GENERATOR

FIELD OF THE INVENTION

The present invention relates to swimming pool wave-generating apparatus, and in particular swimming pool wave-generating apparatus producing individual surf or tidal waves alone or in sequence.

BACKGROUND OF THE INVENTION

Previous swimming pools having wave-generating apparatus have produced periodic waves or other forms of water motion at short regular intervals which are produced by periodic applications of energy, either through air pressure, water pressure, or other mechanical application. The energy is applied in a periodic fashion to produce the desired periodic waves. In systems incorporating air excitation, the water is displaced by periodic application of air pressure or partial vacuum to an auxiliary water displacement chamber or caisson located adjacent to the swimming pool which receives the periodically displaced water, producing the desired wave motion. The periodic wave-generating systems are limited to waves of relatively short periodicity. However, certain water sport activities such as surfing require a large wave with a longer period between each wave. The above-mentioned short-period wave generators cannot produce suitable waves for this purpose.

To produce the desired aperiodic or long-interval surf waves, one approach has been to construct a water reservoir adjacent to and above the water surface of the swimming pool; the release of the contained water into the swimming pool produces the desired wave by adding the volume and potential energy of the stored water. This form of wave generator is limited by the volume of water stored and the rate at which the water can be replaced within the above-mentioned reservoir. Also, the valves used to release water from the reservoir into the swimming pool are normally at least partially underwater at all times, reducing the life of such valves. The reservoir itself is expensive to build and to maintain. Moreover, the high profile of the reservoir is visually unattractive to the otherwise normal pool or natural beach surroundings.

BRIEF DESCRIPTION OF THE INVENTION

The wave generator of the present invention comprises a caisson located adjacent to the swimming pool having a subsurface opening through which water may be rapidly moved from the caisson into the swimming pool, thereby inducing the desired wave motion. The caisson is rapidly pressurized by a stored charge of pressurized air introduced to the top of the caisson, displacing the caisson water downward through the subsurface opening into the swimming pool. The resulting displaced water is directly received by the swimming pool through an unrestricted opening without mechanical water valves, thereby reducing the problem of wear and maintenance of underwater valves. The pneumatic valves and the plumbing associated with the present invention are substantially removed from the presence of water, thus increasing the lifetime of the system. The pressure chamber has a substantially low profile providing no visual obstruction to the surrounding landscape. Moreover, the concrete structure necessary is simplified, reducing the costs associated with construction and maintenance of the pool and wave generator. Furthermore, the caisson may be subdivided into smaller sections, allowing for increased structural support. The surf generator of the present invention may also be implemented in conjunction with other wave generating methods and systems, without any limitation of the effectiveness of either system.

BRIEF DESCRIPTION OF THE DRAWING

These and other features of the present invention can be better understood by reading the following, solely examplary, detailed description, taken together with the drawing, wherein.

DETAILED DESCRIPTION OF THE INVENTION

Figure 1:
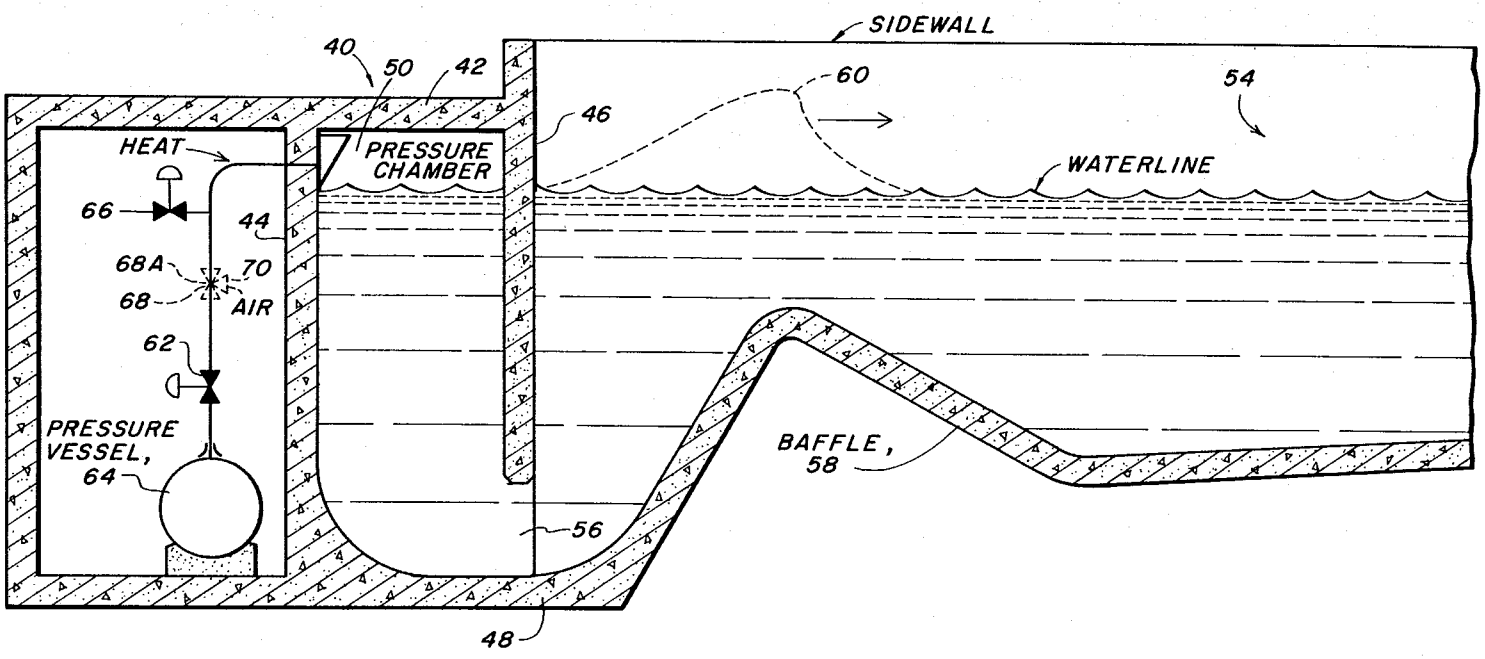
FIG. 1 is a vertical cross-section of the swimming pool and caisson structure.

A vertical cross-section of the swimming pool surf wave generator according to the present invention is shown in FIG. 1. The wave generator includes a pressurized chamber 50 within a caisson 40 having a top section 42, a side 44, and a side 46 shared with the swimming pool 54. The sidewall 46 stops short of the bottom 48 to form an aperture or opening 56 allowing the water within the pressure chamber 50 to communicate with the water of the pool 54. The water from chamber 50 is displaced by a charge of air pressure through valve 62 from a reservoir of compressed air 64. The pressure reservoir 64 is charged by a conventional compressor (not shown) to a pressure for example of 600 kPa ( PSI). The compressed air is rapidly induced into the chamber 50 at a high velocity, thereby rapidly displacing the water into the swimming pool 54 to produce the surf wave. The floor of the swimming pool 54 includes a baffle 58 which upwardly directs the water displaced from the chamber 50 into the swimming pool 54 in a manner to produce a surface wave shown in phantom 60, which propagates laterally across the surface of the pool 54 away from the sidewall 46. The stored potential energy released by the expanding air is converted into kinetic energy, producing the wave 60. This converted kinetic energy is applied to the pressure chamber at high velocities sufficient to displace the water contained therein to produce the desired wavefront. After the wave 60 is generated, the water is allowed to return into the pressure chamber 50 from the swimming pool 54 by controllably exhausting the air from the chamber 50 through valve 66 to the atmosphere. The valve 66 is operated in a manner to control the reentry of the water, to limit the turbulence within the chamber, and control the degree by which the plumbing is immersed or splashed by the water. Moreover, the pool 54 can be constructed according to known techniques so that the created wave 60 is not reflected back towards the wall 46, but is entirely dissipated without reflection. The water flows back into the chamber 50 without assistance by a return wave reflected from the distant pool wall 52. It is therefore seen according to the present invention that the generation of each wave is independent of the previously generated surf waves. The system is limited only through the ability of the pressure vessel to recharge, and by the ability of the water to return to the quiescent level within the chamber 50.

The efficiency of the system according to the present invention is increased by additional air expansion within the pressure chamber 50. The energy stored as air pressure may be converted to a higher velocity flow of air through the use of a jet pipe 68 whose operation is known, shown in phantom in FIG. 1. The jet pipe 68 permits a high-pressure air source to expand to a very low absolute pressure to enhance the transfer of the expansion energy into kinetic energy. The jet valve 68 also permits the induction of a larger amount of air from the atmosphere through a vent 70 into the jet pipe 68 constriction 68A.

A further increase in efficiency is provided by heating the air by a heater (not shown) to increase the volume of the expanded air within chamber 50. Moreover, the heated air is also used to warm the water of the swimming pool.

Figure 2:
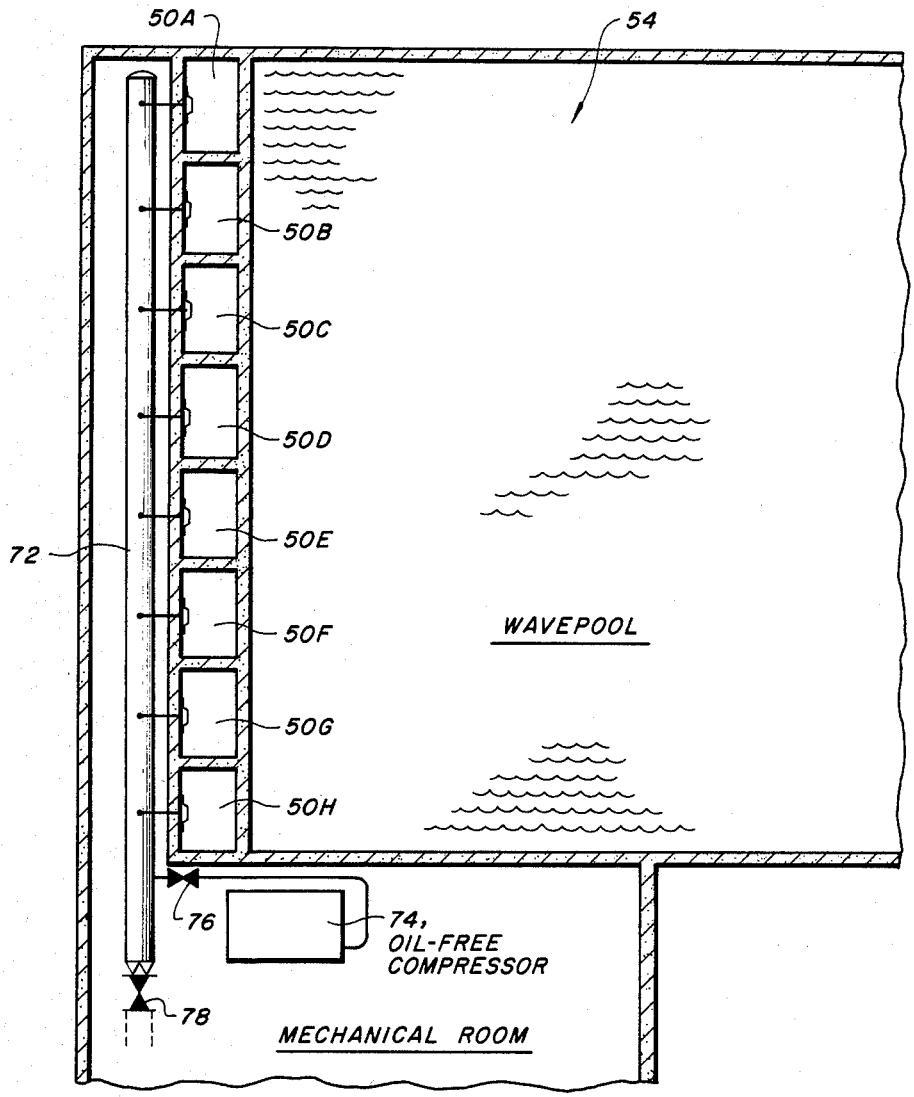
FIG. 2 is a cross-sectional plan view showing a multiple section caisson implementation.

The present invention is shown in a vertical plan view of FIG. 2, producing a wave motion over the surface of the pool 54 by displacing water from a caisson having a plurality of similar chambers 50A, 50B, . . . 50H. The caisson chambers 50A–50H are pressurized through a manifold 72 having a pressure provided by a compressor 74. The pressurized air is introduced into the manifold 72 by a valve 76. The manifold 72 may also be used in conjunction with alternate wave-generating apparatus (not shown) connected by a pressure-control valve 78.

Figure 3:
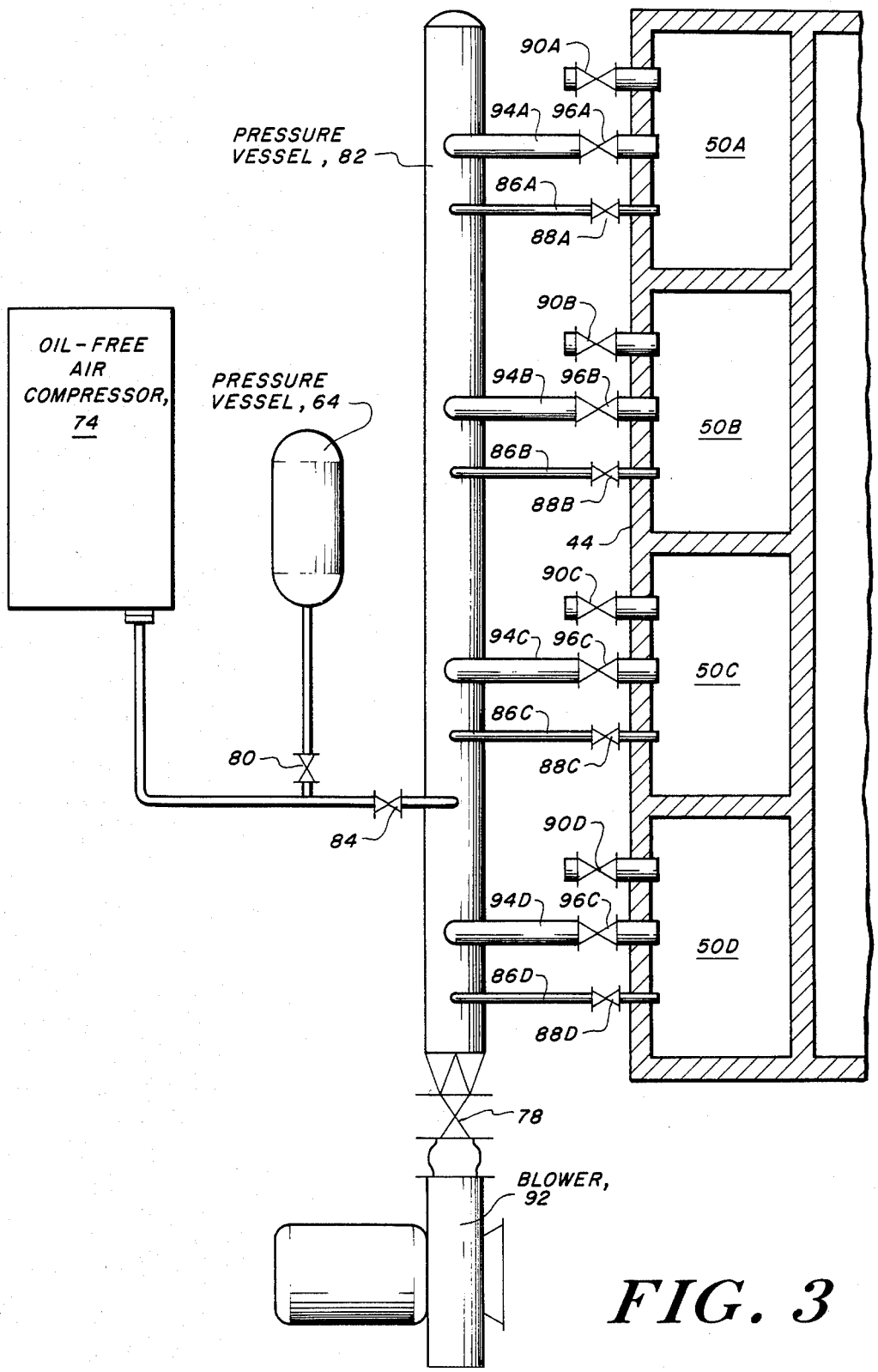
FIG. 3 is a plan view of the present invention partly in section in combination with periodic wave generators.

A more complete combination of the present invention and alternate wavegenerating apparatus is shown in FIG. 3, wherein the swimming pool 54 and the pressure chambers 50A–50D are pressurized by a dual pressurization system to produce different wave motions. The present invention includes an oil-free air compressor 74 which produces the pressurized air without contamination to the pressure vessel 64 through a control valve 80. The air reservoir 64 is charged by closing the valve 84 and opening the valve 80 while the compressor 74 is running. Flow from the air compressor 74 or the air reservoir 64 into the manifold 82 is controlled by valve 84. After the air reservoir 64 is charged, the reservoir 64 air, together with the air provided by the compressor, is vented into the manifold 82 by opening both valves 80 and 84. The charge or pressurized air flows through the dual manifold 82 and is vented into the chambers 50A–50D through the high-pressure lines 86A–86D and valves 88A–88D respectively. The pressurized air displaces the water from the chambers 50A–50D, causing the wave to propagate over the surface of the pool 54, as discussed above. The water is permitted to return into the chambers 50A–50D by exhausting the chamber to the atmosphere through valves 90A–90D.

The alternate wave generating elements generate waves by providing a pressure flow of air through the conduit 82 with a blower 92, the pressurized air being cyclically vented into the chambers 50A–50D through low-pressure ducts 94A–94D and valves 96A–96D. The waves which are produced by the alternate wave generator are typically lower in height and synchronized to previous waves, according to the flow of air introduced by valves 96A–96D and exhausted through valves 90A–90D to the atmosphere.

The resulting wave generator is economical, efficient, and functionally flexible. The resulting structure is estheticall unobtrusive, since the pressure chamber 50 does not extend significantly above the average height of the water level, typically only 3 feet. Moreover, the top surface 42 of the caisson 40 may also form the normal pool walkways or sitting surfaces surrounding the swimming pool 54.

The above implementation as well as modifications of or substitution for various system elements by one skilled in the art is within the scope of the present invention, which is not to be limited except by the claims which follow.

What is claimed is:

1. For use with a swimming pool, a surf wave generator comprising:

one or more air chamber extending at least partially along one side of said swimming pool, having an opening allowing the lower portion of the chamber to communicate with the lower portion of the swimming pool;

a reservoir of compressed air; and means to rapidly induce said compressed air from said reservoir into said air chamber, displacing water therein into said swimming pool;

said reservoir having sufficient volume of compresed air to propagate a single travelling wave within said pool.

2. The apparatus of claim 1, further including means to vent the chamber to the atmosphere.

3. The apparatus of claim 1, further including a jet pipe, wherein the compressed air is expanded through the jet valve providing a transfer of energy resulting in the displacement of the water in the air chamber.

4. The apparatus of claim 3, wherein said jet valve further includes a vent for inducing additional air into the air chamber from the atmosphere.

5. The apparatus of claim 3, further comprising:

means to connect the reservoir of compressed air to the means to rapidly induce; and means to connect the air chamber to the means to rapidly induce, wherein said means to vent is attached to said means to connect the air chamber, selectively venting the air chamber to the atmosphere.

6. The apparatus of claim 5, wherein said means to connect the air chamber includes said jet pipe.

7. The apparatus according to claim 1, further including means to heat the air providing increased efficiency of the wave generator.

8. A method of surf wave generation in a swimming pool having a water-filled caisson coupled to the swimming pool beneath the swimming pool water surface, comprising the steps of:

compressing air;

storing a volume of compressed air in a container;

releasing the entire volume of compressed air into said caisson, wherein the compressed air expands to displace the caisson water into the swimming pool; and controllably releasing the expanded volume of air from the caisson allowing the displaced water to return into the caisson.

9. The method of claim 8, further comprising the step of:

heating the volume of air to be released into said water-filled caisson.

10. The method of claim 8, further comprising the step of:

inducing additional air into the caisson with a jet pipe.

* * * * *